US012649609B2

(12) United States Patent
Zhao et al.

(10) Patent No.: US 12,649,609 B2
(45) Date of Patent: Jun. 9, 2026

(54) DETACHABLE OUTDOOR STORAGE BOX

(71) Applicant: ZHEJIANG LINYA CO., LTD, Zhejiang (CN)

(72) Inventors: Niangao Zhao, Zhejiang (CN); Xiaolei Fu, Zhejiang (CN)

(73) Assignee: ZHEJIANG LINYA CO., LTD, Zhejiang (CN)

( * ) Notice: Subject to any disclaimer, the term of this patent is extended or adjusted under 35 U.S.C. 154(b) by 133 days.

(21) Appl. No.: 18/659,008

(22) Filed: May 9, 2024

(65) Prior Publication Data

US 2025/0346399 A1 Nov. 13, 2025

(30) Foreign Application Priority Data

Mar. 10, 2023 (CN) ..... 202320447281.X

(51) Int. Cl.
*B65D 21/08* (2006.01)
*B65D 25/24* (2006.01)
*B65D 43/16* (2006.01)

(52) U.S. Cl.
CPC ..... *B65D 21/086* (2013.01); *B65D 25/24* (2013.01); *B65D 43/163* (2013.01); *B65D 2543/00194* (2013.01)

(58) Field of Classification Search
CPC ..... B65D 11/1893; B65D 90/08; B65D 11/1873; B65D 21/086; B65D 25/24; B65D 43/163; B65D 2543/00194
See application file for complete search history.

(56) References Cited

U.S. PATENT DOCUMENTS

2008/0308447 A1* 12/2008 Boland ..... B65D 25/005 206/512
2014/0197168 A1* 7/2014 Miller ..... B65D 21/0215 220/4.33
2020/0140139 A1* 5/2020 Lilholt ..... B65D 11/1873
2020/0165030 A1* 5/2020 Song ..... B65D 25/24
2020/0207513 A1* 7/2020 Highers ..... B65D 11/1873
2023/0067173 A1* 3/2023 Anderson ..... B65D 11/28
2024/0294325 A1* 9/2024 Berko ..... B65D 88/22

* cited by examiner

*Primary Examiner* — Shawn M Braden
(74) *Attorney, Agent, or Firm* — JCIPRNET

(57) ABSTRACT

The disclosure relates to the technical field of cabinet splicing and specifically relates to a quick-splicing structure and a cabinet. A quick-splicing structure for quick connection between two surfaces includes at least one group of slidably fitting components and a plurality of groups of locking components. The slidably fitting components include a first member and a second member that are slidably fitted and disposed on the two surfaces. The locking components include a first fastener and a second fastener that are fitted to be locked and respectively disposed on the two surfaces, and the plurality of groups of locking components and the slidably fitting components are arranged in an alternating manner in a locking direction. The disclosure further provides a cabinet including the quick-splicing structure. A plurality of the cabinets are connected horizontally and/or vertically through the quick-splicing structure.

19 Claims, 3 Drawing Sheets

DETACHABLE OUTDOOR STORAGE BOX

CROSS-REFERENCE TO RELATED APPLICATION

This application claims the priority benefit of China application serial no. 202320447281.X, filed on Mar. 10, 2023. The entirety of the above-mentioned patent application is hereby incorporated by reference herein and made a part of this specification.

BACKGROUND

Technical Field

The present invention belongs to the technical field of storage devices, and particularly relates to a detachable outdoor storage box.

Description of Related Art

Usually, various tools need to be used in outdoor activities, and these tools need to be contained in one box. In the prior art, the box for containing the tools for the outdoor activities is usually an ordinary box, which is single in function and cannot provide more convenience for the outdoor activities. In addition, at present, there are various storage boxes in the market. However, most of the storage boxes are inconvenient to assemble, cannot be quickly assembled particularly when used outdoors, and cannot be quickly disassembled to avoid the trouble in transportation when not containing the tools.

SUMMARY

In order to make up the shortcomings in the prior art, the present invention provides a detachable outdoor storage box, comprising a box body, a bottom plate arranged at the bottom of the box body in a fitted manner, and a box cover arranged at the top of the box body in a fitted manner, where the box body is detachably snap-fitted with the bottom plate and the box cover; the bottom plate comprises a plurality of clamped and spliced unit plates, and adjacent ends of the unit plates are provided with corresponding clamping grooves or bumps for fitted connection; and the box body comprises a plurality of surrounding plates, the bottoms of the surrounding plates are snap-fitted with the unit plates, and the tops of the surrounding plates are snap-fitted with the box cover.

Further, the box body comprises two long surrounding plates and two short surrounding plates, and the adjacent long surrounding plates and short surrounding plates are connected in a fitted manner by means of stand columns.

Further, the bottom plate comprises two unit plates snap-fitted with each other, adjacent side edges of the two unit plates are provided with snap-fitting members, another three side edges of each of the unit plates are provided with a plurality of bottom plate recesses to be fitted with and fixed to the surrounding plates, and two corners of each of the unit plates away from a joint are provided with connection grooves fitted with the stand columns.

Further, each of the snap-fitting members comprises the clamping groove or the bump which is arranged on each of the two unit plates, the clamping groove is snap-fitted with the bump to splice the unit plates, and then screw members are fitted for strengthening.

Further, each of the snap-fitting members further comprises a protruding column or a column sleeve which is arranged at an adjacent position of the two unit plates, and the protruding column and the column sleeve are snap-fitted with each other.

Further, a plurality of rolling wheels are arranged at the bottom of each of the unit plates.

Further, the box cover comprises a top frame and a top cover, the top frame and an upper portion of the box body are mounted in a fitted manner, the top cover movably covers the top frame, and the top cover and the top frame are connected by means of hinges.

Further, opening and closing members are arranged between the top cover and the top frame, upper ends of the opening and closing members are hinged to an inner side of the top cover by means of L-shaped connectors and screw members, lower ends of the opening and closing members are hinged to an inner side of the top frame, and opening and closing adjustment of the top cover is achieved by means of the opening and closing members.

Further, the top frame comprises long frames clamped with the tops of the long surrounding plates and short frames clamped with the tops of the short surrounding plates, the adjacent long frames and short frames are connected in a fitted manner by means of corner connectors, and the corner connectors are snap-fitted with the tops of the stand columns.

Further, each of the corner connectors comprises a right-angle member and a corner cover, the right-angle member is configured to connect the respective adjacent long frame and short frame, the corner cover is configured to coat and cover a joint of the adjacent long frame and short frame, and the corner cover is clamped with the top of the respective stand column.

Compared with the prior art, the present invention has the following advantages:

(1) the bottom plate is configured to comprise the unit plates snap-fitted with each other, the box body is configured to be of a structure comprising the plurality of surrounding plates, and the box cover is configured to be of a structure comprising the top frame and the top cover, thereby achieving convenient assembly and disassembly of the storage box and convenient transportation of small components;

(2) the bottom plate is formed by connecting the two unit plates, which are snap-fitted by concave-convex fitting of the bumps and the clamping grooves, the screw members are fitted for strengthening and locking, and the arrangement of the unit plates better facilitates transportation; and (3) the bottom plate is provided with the bottom plate recesses which are more conveniently fitted with the surrounding plates for mounting, and the rolling wheels at the bottom of the bottom plate facilitate movement of the storage box.

Figure 1:
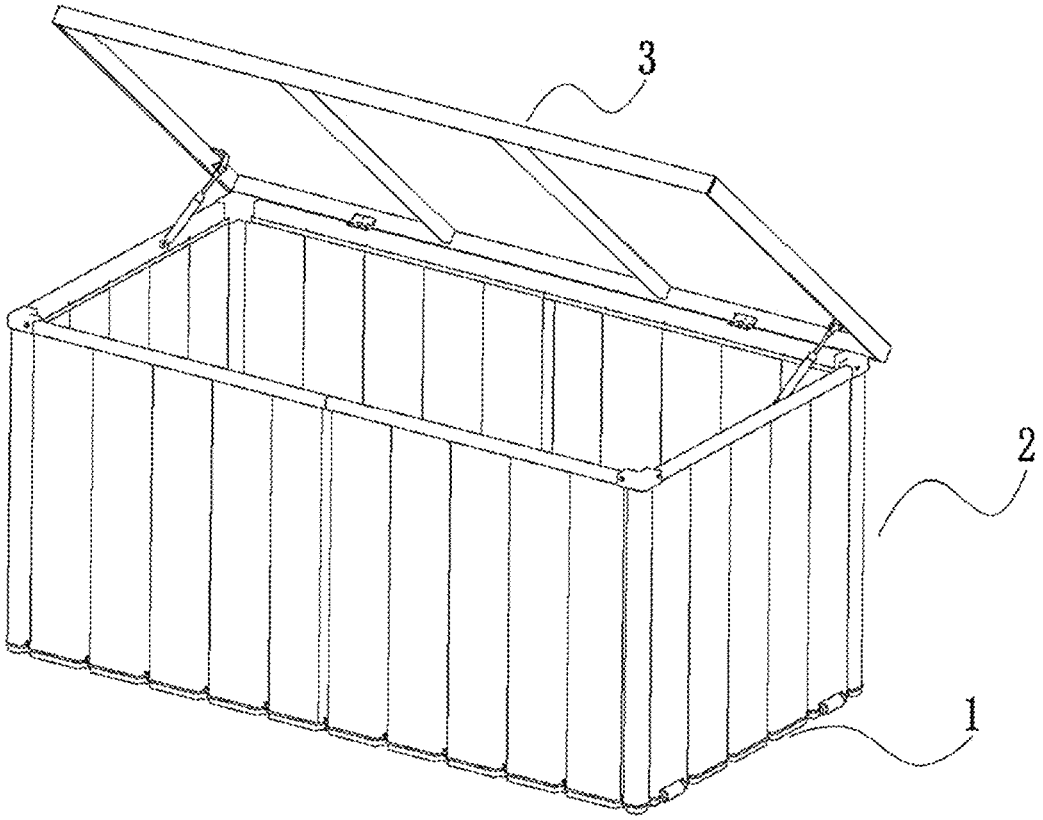
FIG. 1 is a structural schematic diagram of the present invention.

In the drawings: 1—bottom plate, 11—unit plate, 12—bump, 13—clamping groove, 14—protruding column, 15—column sleeve, 16—recess, 17—protrusion, 18—bottom plate recess, 19—connection groove, 2—box body, 21—long surrounding plate, 22—short surrounding plate, 23—stand column, 3—box cover, 31—top frame, 311—long frame, 312—short frame, 32—top cover, 4—opening and closing member, 5—corner connector, 51—right-angle member, 52—corner cover, 6—hinge, 7—L-shaped connector, and 8—rolling wheel.

DESCRIPTION OF THE EMBODIMENTS

A detachable outdoor storage box in the present invention will be further illustrated below in conjunction with accompanying drawings.

Figure 2:
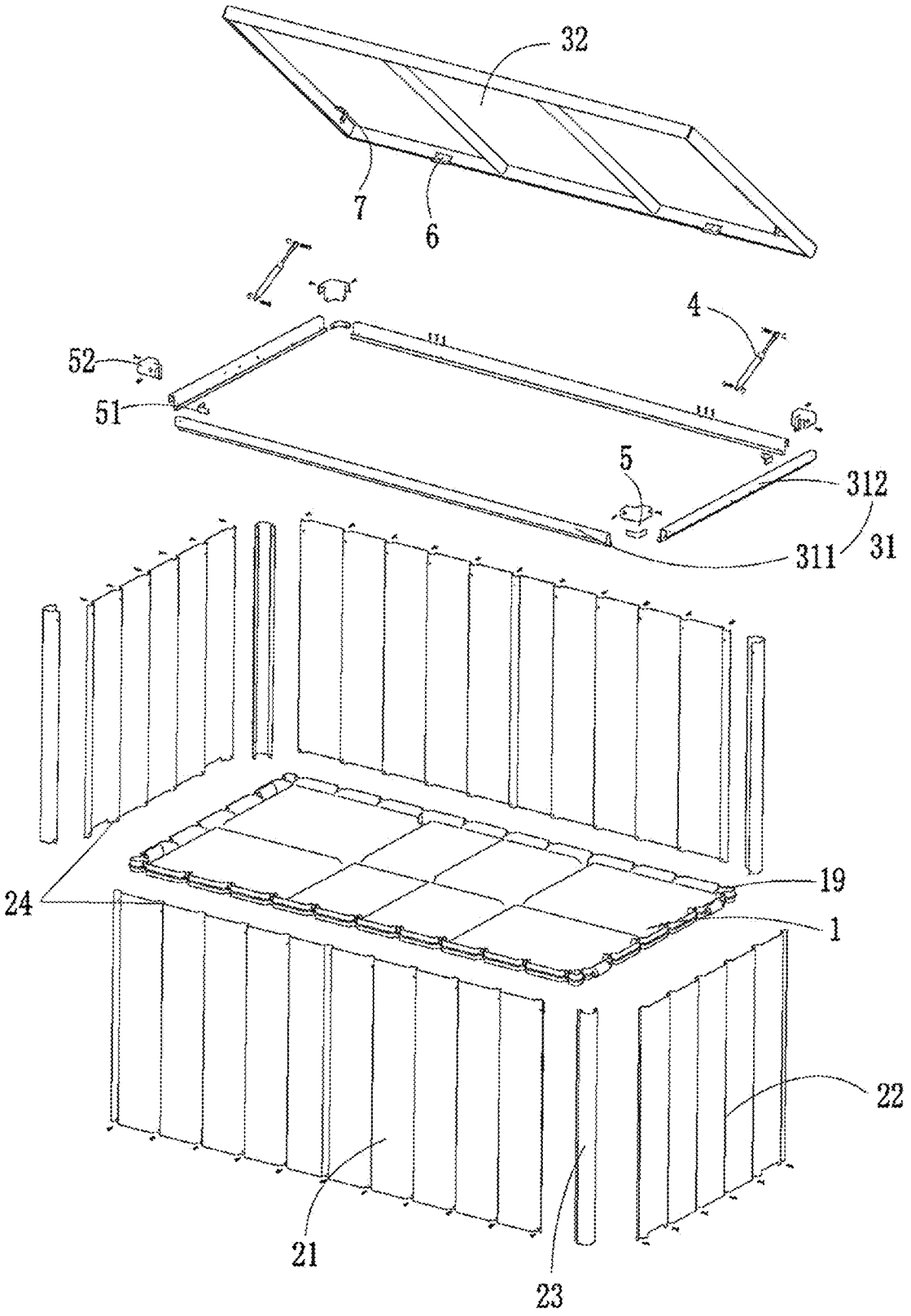
FIG. 2 is an exploded schematic diagram of the present invention.

As shown in FIGS. 1-2, the detachable outdoor storage box includes a box body 2, a bottom plate 1 arranged at the bottom of the box body 2 in a fitted manner, and a box cover 3 arranged at the top of the box body 2 in a fitted manner, where the box cover 3 includes a top frame 31 and a top cover 32, the top frame 31 and an upper portion of the box body 2 are mounted in a fitted manner, the top cover 32 movably covers the top frame 31, and the top cover 32 and the top frame 31 are connected by means of hinges 6. In addition, opening and closing members 4 are arranged between the top cover 32 and the top frame 31, upper ends of the opening and closing members 4 are hinged to an inner side of the top cover 32 by means of L-shaped connectors 7 and screw members, lower ends of the opening and closing members 4 are hinged to an inner side of the top frame 31, and opening and closing adjustment of the top cover 32 is achieved by means of the opening and closing members 4, thereby facilitating usage. The opening and closing members 4 are dampers, air springs, air cylinders or hydraulic rods. The box body 2 includes a plurality of surrounding plates, and in this embodiment, includes two long surrounding plates 21 and two short surrounding plates 22, the adjacent long surrounding plates 21 and short surrounding plates 22 are connected in a fitted manner by means of stand columns 23, the stand columns 23 are of an open surrounding frame structure, and the two open side edges are respectively connected and fixed in a fitted manner to the surrounding plates on two sides by means of screw members. The top frame 31 is snap-fitted with the upper portion of the box body 2, the top frame 31 includes long frames 311 clamped with the tops of the long surrounding plates 21 and short frames 312 clamped with the tops of the short surrounding plates 22, clamping grooves are formed in the bottoms of the long frames 311 and the short frames 312, the adjacent long frames 311 and short frames 312 are connected in a fitted manner by means of corner connectors 5, and the corner connectors 5 are snap-fitted with the tops of the stand columns 23. Each of the corner connectors 5 includes a right-angle member 51 for connecting the adjacent long frame 311 and short frame 312 and a corner cover 52, one end of the right-angle member 51 is fixed to an inner wall of a recess of the long frame 311, the other end is fixed to an inner wall of a recess of the short frame 312, the corner cover 52 is configured to coat and cover a joint of the adjacent long frame 311 and short frame 312, and the corner cover 52 is clamped with the top of the stand column 23.

The bottom plate 1 is snap-fitted with the box body 2, the bottom plate 1 is provided with a plurality of bottom plate recesses 18, correspondingly, the surrounding plates of the box body 2 are provided with a plurality of longitudinal protrusions 24, the longitudinal protrusions 24 are snap-fitted with the bottom plate recesses 18, and then screw members are fitted for strengthening. Four corners of the bottom plate 1 are provided with connection grooves 19, which are snap-fitted with the bottoms of the stand columns 23. The bottom plate 1 includes a plurality of spliced unit plates 11, the unit plates 11 are snap-fitted with each other by means of snap-fitting members, the snap-fitting members include clamping grooves 13 and bumps 12 which are respectively arranged on the two adjacent unit plates 11, and the clamping grooves 13 are snap-fitted with the bumps 12.

Figure 3:
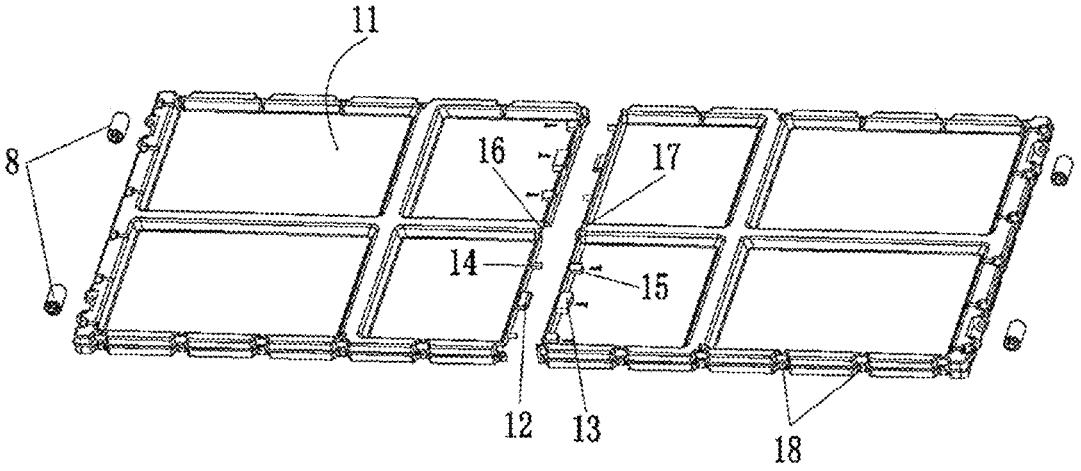
FIG. 3 is a structural schematic diagram of a bottom plate in the present invention.

As shown in FIG. 3, in this embodiment, the bottom plate 1 includes two unit plates 11 snap-fitted with each other, adjacent sides of the two unit plates 11 are respectively provided with the clamping grooves 13 or the bumps 12, the other sides are provided with rolling wheels 8, the clamping grooves 13 are snap-fitted with the bumps 12 to splice the unit plates 11, and then screw members are fitted for strengthening; and the free movement of the storage box is achieved by means of the rolling wheels 8. In order to increase the snap-fitting firmness, protruding columns 14 or column sleeves 15 clamped with each other can also be arranged on two sides of the clamping grooves 13 and the bumps 12, and the screw members are fitted for strengthening. The unit plates 11 are further provided with reinforcing ribs, and the reinforcing ribs at snap-fit positions of the two unit plates 11 are also configured as protrusions 17 and recesses 16 of snap-fit structures. One side of each unit plate 11 is provided with the snap-fitting members, another three side edges are provided with the plurality of bottom plate recesses 18 to be fitted with and fixed to the surrounding plates, and two corners of the unit plate 11 away from a joint are provided with the connection grooves 19 fitted with the stand columns 23.

During specific mounting, the bottom plate 1, the box body 2 and the box cover 3 are spliced respectively, then the box body 2 is clamped with the bottom plate 1 and is locked by means of the screw members, and finally, the box cover 3 is fastened to the box body 2.

Finally, it should be noted that the above embodiments are only for illustrating the technical solutions of the present invention, and are not limitations; although the present invention is illustrated in detail with reference to the above-mentioned embodiments, those of ordinary skill in the art should understand that they can still amend the technical solutions recited in the above-mentioned embodiments, or perform equivalent substitutions on part or all of the technical features thereof; and such amendments or substitutions do not make the essence of the corresponding technical solutions depart from the scope of the technical solutions of the embodiments of the present invention.

What is claimed is:

1. A detachable outdoor storage box, comprising a box body, a bottom plate arranged at the bottom of the box body in a fitted manner, and a box cover arranged at the top of the box body in a fitted manner, wherein the box body is detachably snap-fitted with the bottom plate and the box cover; the bottom plate comprises a plurality of clamped and spliced unit plates, and adjacent ends of the unit plates are provided with corresponding clamping grooves or bumps for fitted connection; and the box body comprises a plurality of surrounding plates, the bottoms of the surrounding plates are snap-fitted with the unit plates, and the tops of the surrounding plates are snap-fitted with the box cover, wherein the box body comprises two long surrounding plates and two short surrounding plates, the adjacent long surrounding plates and short surrounding plates are connected in a fitted manner by means of stand columns, and each of the long surrounding plates and the short surrounding plates is provided with a plurality of longitudinal protrusions.

2. The detachable outdoor storage box according to claim 1, wherein the bottom plate comprises two unit plates snap-fitted with each other, adjacent side edges of the two unit plates are provided with snap-fitting members, another three side edges of each of the unit plates are provided with a plurality of bottom plate recesses to be snap-fitted with the longitudinal protrusions of the surrounding plates, and two corners of each of the unit plates away from a joint are provided with connection grooves fitted with the stand columns.

3. The detachable outdoor storage box according to claim 2, wherein each of the snap-fitting members comprises the clamping groove or the bump which is arranged on each of the two unit plates, the clamping groove is snap-fitted with the bump to splice the unit plates, and then screw members are fitted for locking.

4. The detachable outdoor storage box according to claim 2, wherein each of the snap-fitting members further comprises a protruding column or a column sleeve which is arranged at an adjacent position of the two unit plates, and the protruding column and the column sleeve are snap-fitted with each other.

5. The detachable outdoor storage box according to claim 2, wherein a plurality of rolling wheels (8) are arranged at the bottom of each of the unit plates.

6. The detachable outdoor storage box according to claim 1, wherein the box cover comprises a top frame and a top cover, the top frame and an upper portion of the box body are mounted in a fitted manner, the top cover movably covers the top frame, and the top cover and the top frame are connected by means of hinges.

7. The detachable outdoor storage box according to claim 6, wherein opening and closing members are arranged between the top cover and the top frame, upper ends of the opening and closing members are hinged to an inner side of the top cover by means of L-shaped connectors and screw members, lower ends of the opening and closing members are hinged to an inner side of the top frame, and opening and closing adjustment of the top cover is achieved by means of the opening and closing members.

8. The detachable outdoor storage box according to claim 7, wherein the top frame comprises long frames clamped with the tops of the long surrounding plates and short frames clamped with the tops of the short surrounding plates, the adjacent long frames and short frames are connected in a fitted manner by means of corner connectors, and the corner connectors are snap-fitted with the tops of the stand columns.

9. The detachable outdoor storage box according to claim 7, wherein each of the corner connectors comprises a right-angle member and a corner cover, the right-angle member is configured to connect the respective adjacent long frame and short frame, the corner cover is configured to coat and cover a joint of the adjacent long frame and short frame, and the corner cover is clamped with the top of the respective stand column.

10. The detachable outdoor storage box according to claim 2, wherein the box cover comprises a top frame and a top cover, the top frame and an upper portion of the box body are mounted in a fitted manner, the top cover movably covers the top frame, and the top cover and the top frame are connected by means of hinges.

11. The detachable outdoor storage box according to claim 3, wherein the box cover comprises a top frame and a top cover, the top frame and an upper portion of the box body are mounted in a fitted manner, the top cover movably covers the top frame, and the top cover and the top frame are connected by means of hinges.

12. The detachable outdoor storage box according to claim 4, wherein the box cover comprises a top frame and a top cover, the top frame and an upper portion of the box body are mounted in a fitted manner, the top cover movably covers the top frame, and the top cover and the top frame are connected by means of hinges.

13. The detachable outdoor storage box according to claim 5, wherein the box cover comprises a top frame and a top cover, the top frame and an upper portion of the box body are mounted in a fitted manner, the top cover movably covers the top frame, and the top cover and the top frame are connected by means of hinges.

14. The detachable outdoor storage box according to claim 10, wherein opening and closing members are arranged between the top cover and the top frame, upper ends of the opening and closing members are hinged to an inner side of the top cover by means of L-shaped connectors and screw members, lower ends of the opening and closing members are hinged to an inner side of the top frame, and opening and closing adjustment of the top cover is achieved by means of the opening and closing members.

15. The detachable outdoor storage box according to claim 14, wherein the top frame comprises long frames clamped with the tops of the long surrounding plates and short frames clamped with the tops of the short surrounding plates, the adjacent long frames and short frames are connected in a fitted manner by means of corner connectors, and the corner connectors are snap-fitted with the tops of the stand columns.

16. The detachable outdoor storage box according to claim 14, wherein each of the corner connectors comprises a right-angle member and a corner cover, the right-angle member is configured to connect the respective adjacent long frame and short frame, the corner cover is configured to coat and cover a joint of the adjacent long frame and short frame, and the corner cover is clamped with the top of the respective stand column.

17. The detachable outdoor storage box according to claim 11, wherein opening and closing members are arranged between the top cover and the top frame, upper ends of the opening and closing members are hinged to an inner side of the top cover by means of L-shaped connectors and screw members, lower ends of the opening and closing members are hinged to an inner side of the top frame, and opening and closing adjustment of the top cover is achieved by means of the opening and closing members.

18. The detachable outdoor storage box according to claim 17, wherein the top frame comprises long frames clamped with the tops of the long surrounding plates and short frames clamped with the tops of the short surrounding plates, the adjacent long frames and short frames are connected in a fitted manner by means of corner connectors, and the corner connectors are snap-fitted with the tops of the stand columns.

19. The detachable outdoor storage box according to claim 17, wherein each of the corner connectors comprises a right-angle member and a corner cover, the right-angle member is configured to connect the respective adjacent long frame and short frame, the corner cover is configured to coat and cover a joint of the adjacent long frame and short frame, and the corner cover is clamped with the top of the respective stand column.

* * * * *